US011021777B2

(12) United States Patent
Kong

(10) Patent No.: US 11,021,777 B2
(45) Date of Patent: Jun. 1, 2021

(54) TRIPLE-PHASE STAINLESS STEEL AND METHOD FOR PRODUCING SAME

(71) Applicant: POSCO, Pohang-si (KR)

(72) Inventor: Jung Hyun Kong, Pohang-si (KR)

(73) Assignee: POSCO, Pohang-si (KR)

( * ) Notice: Subject to any disclaimer, the term of this patent is extended or adjusted under 35 U.S.C. 154(b) by 78 days.

(21) Appl. No.: 15/781,282

(22) PCT Filed: Aug. 30, 2016

(86) PCT No.: PCT/KR2016/009620
§ 371 (c)(1),
(2) Date: Jun. 4, 2018

(87) PCT Pub. No.: WO2017/111255
PCT Pub. Date: Jun. 29, 2017

(65) Prior Publication Data

US 2018/0355460 A1 Dec. 13, 2018

(30) Foreign Application Priority Data

Dec. 23, 2015 (KR) ..... 10-2015-0184949

(51) Int. Cl.

| | |
|---|---|
| ***C22C 38/50*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |

(Continued)

(52) U.S. Cl.
CPC ..... *C22C 38/50* (2013.01); *C21D 6/004* (2013.01); *C21D 6/005* (2013.01); *C21D 6/008* (2013.01); *C22C 38/001* (2013.01); *C22C 38/004* (2013.01); *C22C 38/02* (2013.01); *C22C 38/04* (2013.01); *C22C 38/06* (2013.01); *C22C 38/44* (2013.01); *C22C 38/48* (2013.01);

(Continued)

(58) Field of Classification Search
CPC ..... C22C 38/50; C21D 6/004
USPC ..... 420/68
See application file for complete search history.

(56) References Cited

U.S. PATENT DOCUMENTS

| | | | |
|---|---|---|---|
| 4,581,202 | A | 4/1986 | Kudo et al. |
| 2007/0186999 | A1 | 8/2007 | Kuroda et al. |

FOREIGN PATENT DOCUMENTS

| | | | |
|---|---|---|---|
| JP | H07-292446 | A | 11/1995 |
| JP | 2000-239803 | A | 9/2000 |

(Continued)

OTHER PUBLICATIONS

Written Opinion and International Search Report dated Nov. 29, 2016 issued in International Patent Application No. PCT/KR2016/009620 (with partial English translation).

(Continued)

*Primary Examiner* — Weiping Zhu
(74) *Attorney, Agent, or Firm* — Morgan, Lewis & Bockius LLP

(57) ABSTRACT

A triple-phase stainless steel and a method of manufacturing the same are provided. The triple-phase stainless steel includes a ferrite phase formed in a central region, an austenite phase formed in an outermost region comprising a surface, and a martensite phase formed between the ferrite phase and the austenite phase. Thus, a triple-phase stainless steel having excellent corrosion resistance, high strength, and high toughness may be provided.

7 Claims, 6 Drawing Sheets

Triple phase stainless steel

(51) Int. Cl.

| | |
|---|---|
| ***C22C 38/48*** | (2006.01) |
| ***C23C 8/26*** | (2006.01) |
| ***C22C 38/00*** | (2006.01) |
| ***C21D 6/00*** | (2006.01) |

(52) U.S. Cl.
CPC ..... *C23C 8/26* (2013.01); *C21D 2211/001* (2013.01); *C21D 2211/005* (2013.01); *C21D 2211/008* (2013.01)

(56) References Cited

FOREIGN PATENT DOCUMENTS

| | | | |
|---|---|---|---|
| JP | 2001-140041 A | | 5/2001 |
| JP | 2002-194504 A | | 7/2002 |
| JP | 2002194504 A | * | 7/2002 |
| JP | 2003-171744 A | | 6/2003 |
| JP | 2004-244691 A | | 9/2004 |
| JP | 2015-161011 A | | 9/2015 |
| KR | 10-1999-014364 A | | 2/1999 |
| KR | 2001-0102111 A | | 11/2001 |
| KR | 10-0831022 B1 | | 5/2008 |

OTHER PUBLICATIONS

H. Lee, et al., "Microstructural Changes during Tempering Treatment of Nitrogen-permeated STS 410 and 410L Martensitic Stainless Steels," Journal of the Korean Society for Heat Treatment, Mar. 2007, vol. 20, No. 2, pp. 84-93 (with partial English translation).
Korean Office Action dated Jan. 4, 2017 issued in Korean Patent Application No. 10-2015-0184949 (with English translation).
Korean Notice of Allowance dated Jun. 7, 2017 issued in Korean Patent Application No. 10-2015-0184949 (with English translation).
Extended European Search Report issued in European Application No. 16879123.4 dated Oct. 25, 2018.
European Intent to Grant dated Jul. 9, 2019 issued in European Patent Application No. 16879123.4.
Chinese Office Action dated Aug. 27, 2019 issued in Chinese Patent Application No. 201680075769.7 (with English translation).
Japanese Office Action dated Mar. 5, 2019 issued in Japanese Patent Application No. 2018-547238 (with English translation).

* cited by examiner

【FIG. 1】
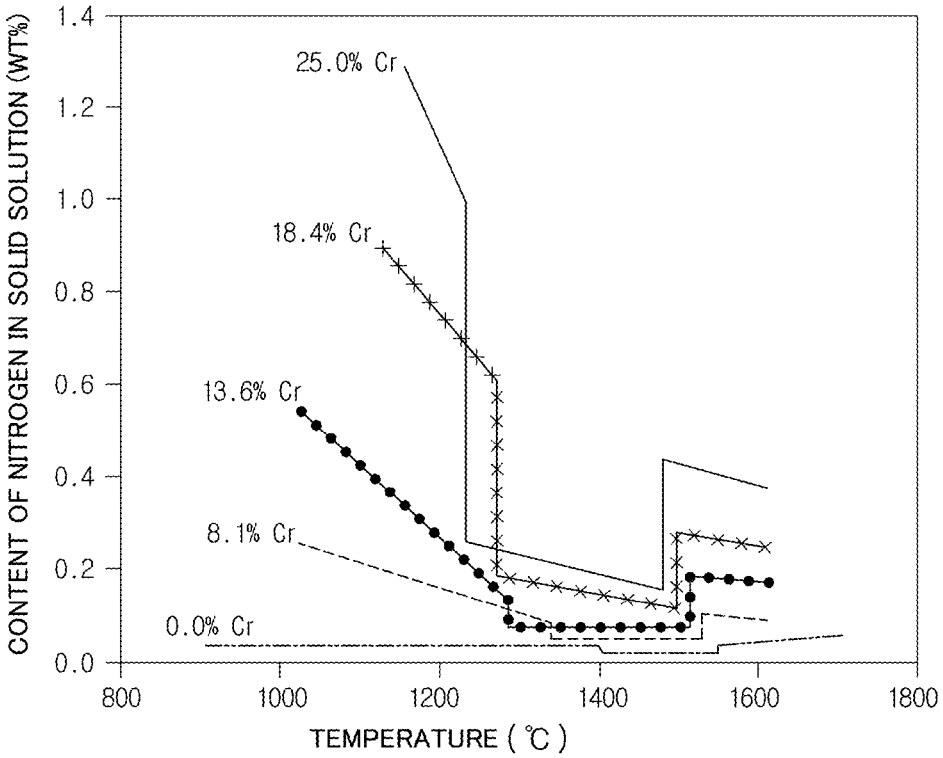

【FIG. 2】
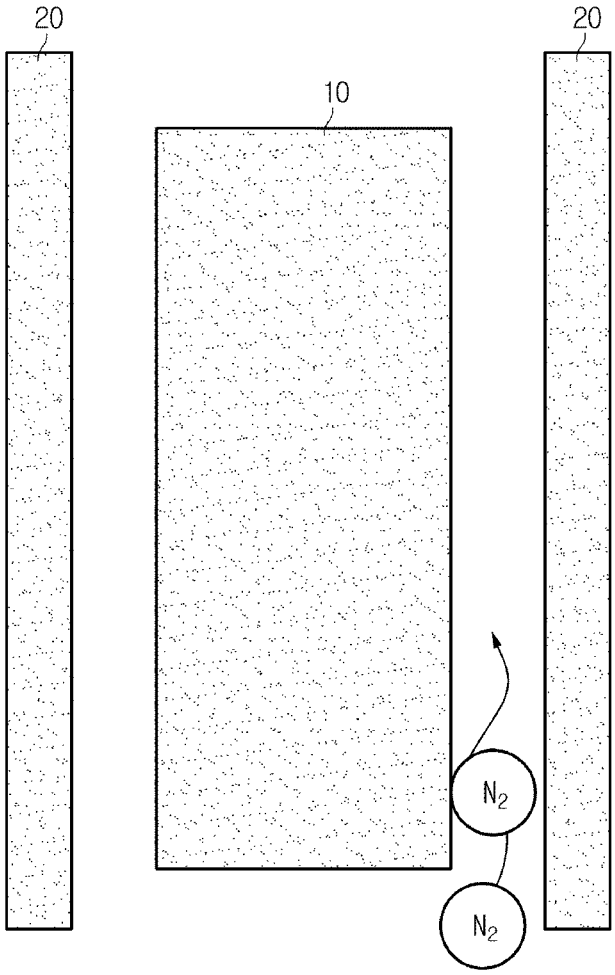

【FIG. 3】
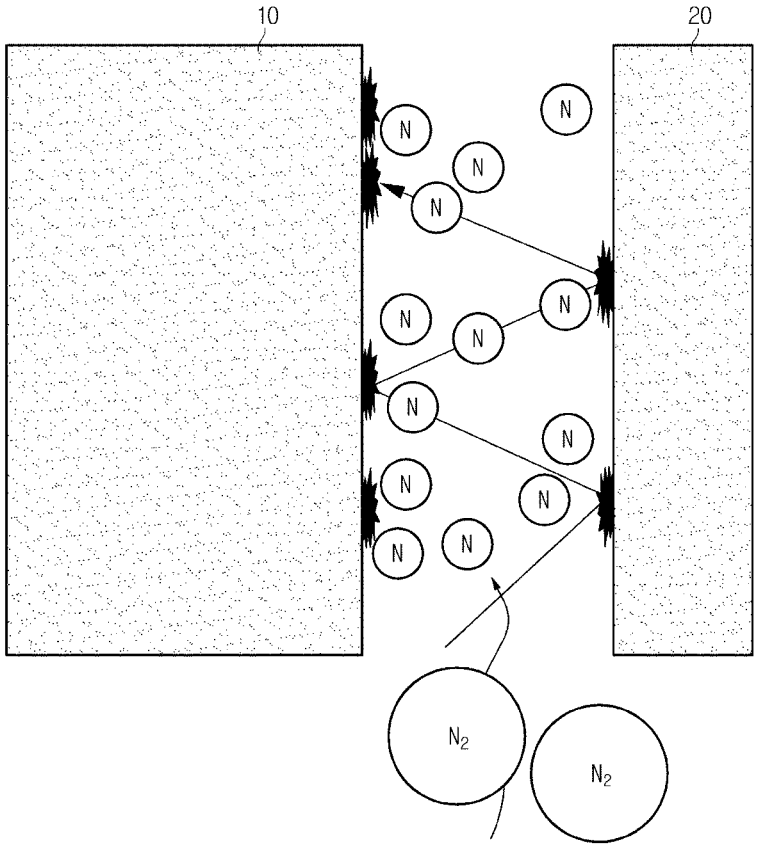

【FIG. 4】
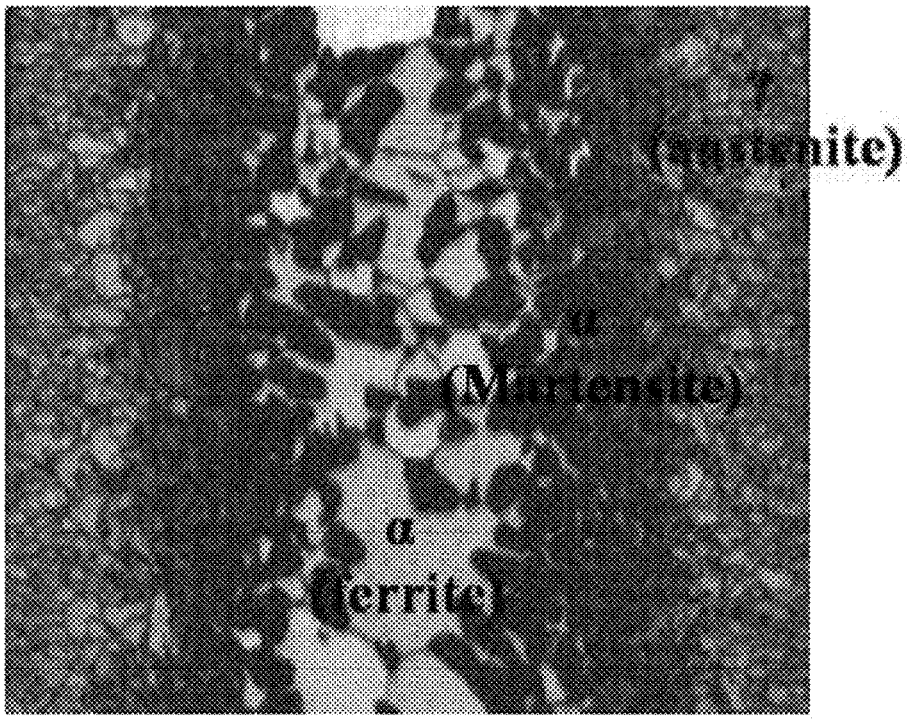
Triple phase stainless steel

【FIG. 5】
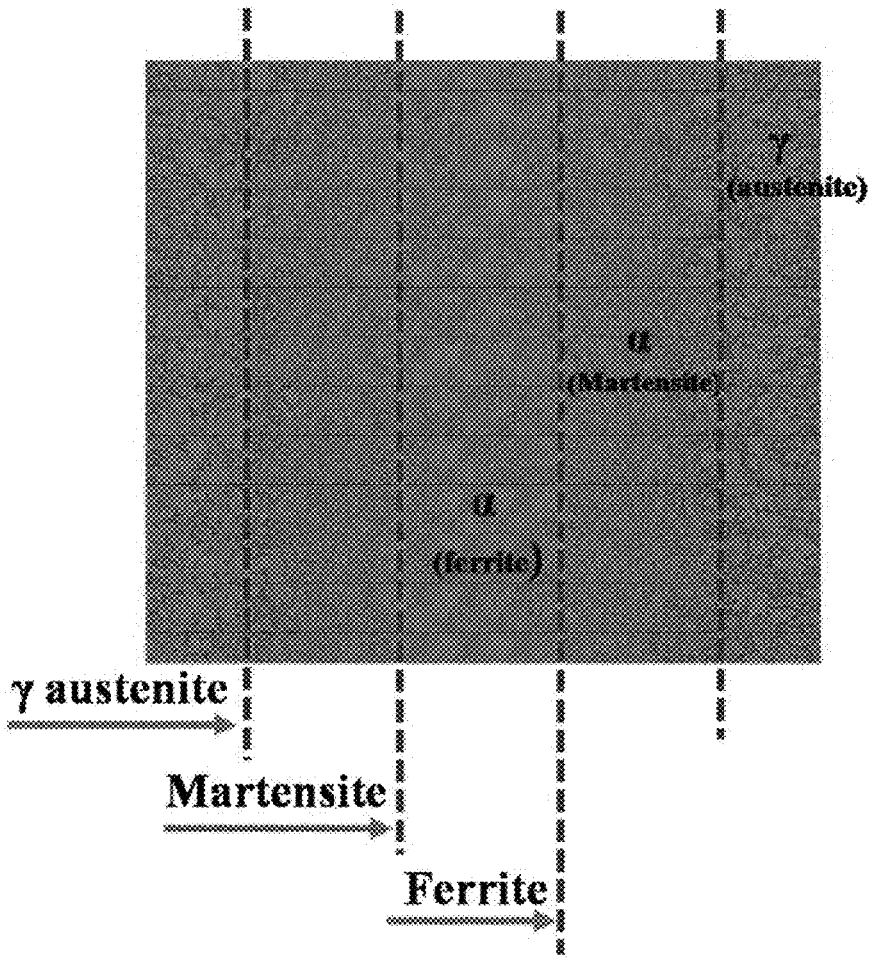

【FIG. 6】
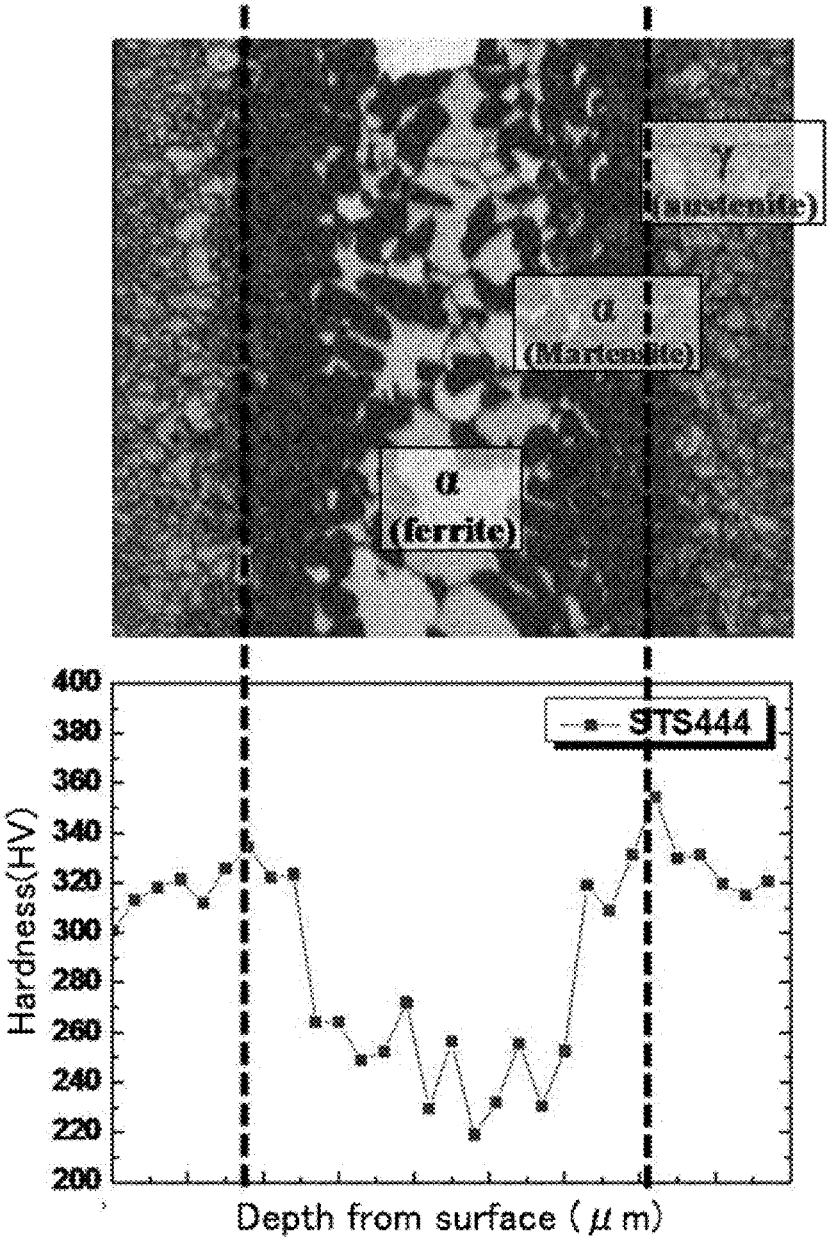

TRIPLE-PHASE STAINLESS STEEL AND METHOD FOR PRODUCING SAME

RELATED APPLICATIONS

This application is the U.S. National Phase under 35 U.S.C. § 371 of International Application No. PCT/KR2016/009620, filed on Aug. 30, 2016 which in turn claims the benefit of Korean Patent Application No. 10-2015-0184949 filed on Dec. 23, 2015, the disclosures of which applications are incorporated by reference herein.

TECHNICAL FIELD

The present disclosure relates to a triple-phase stainless steel and a method of manufacturing the same, and more particularly, to a triple-phase stainless steel obtained by phase-transforming a ferritic stainless steel by permeating generator nitrogen (N) into the surface and the inside of the ferritic stainless steel and a method of manufacturing the same.

BACKGROUND ART

In general, nitrogen, when added to stainless steel, has been known to improve toughness by refining grains and to improve corrosion resistance by delaying precipitation of carbides by reducing a diffusion rate of carbon. Thus, nitrogen has been commonly added to stainless steels in a predetermined rage of amounts to improve strength and corrosion resistance.

Thus, high nitrogen stainless steels have been developed and commercialized by adding nitrogen to a variety of austenitic and dual-phase stainless steels. A solid solubility of nitrogen in a steel is very low, like carbon, and nitrogen is found mainly as nitrides.

Since nitrogen has a smaller atomic radius than carbon and is mainly present in an inert nitrogen gas state, it is very difficult to form a nitrogen solid solution in a steel. Thus, in order to increase a solid solubility of nitrogen, stainless steels including a large amount of alloying elements having high affinity with nitrogen such as chromium (Cr) may be used. In general, these stainless steel has a high solid solubility of nitrogen.

In general, for formation of a solid solution of nitrogen in an alloy steel, a complicated process and a dedicated pressurizing facility are used to dissolve nitrogen, in an amount from several tens ppm to a solid solubility limit of 0.45%, in a molten metal.

The solid solubility limit of nitrogen in a molten steel is about 0.45% and it is known that further amounts of nitrogen are difficult to be dissolved therein. FIG. 1 is a graph illustrating solid solubility of nitrogen in alloy steels. FIG. 1 illustrates the solid solubility of nitrogen with respect to temperature. That is, it is very difficult to form a solid solution of nitrogen in a molten metal state without using a particular dissolving device such as a pressurizing facility.

Nitrogen permeation heat treatment may be performed to form a solid solution of nitrogen in an alloy steel. This nitrogen permeation treatment is commonly used in stainless steels including elements capable of increasing the solid solubility of nitrogen in an austenite phase such as chromium (Cr), molybdenum (Mo), manganese (Mn), and tungsten (W). Since nitrides easily precipitate simultaneously with nitrogen permeation in steels including elements easily forming nitrides such as titanium (Ti), niobium (Nb), and vanadium (V), corrosion resistance may deteriorate and a solid solution of nitrogen may not be formed.

Meanwhile, since nitrogen is difficult to permeate into ferritic stainless steels having a very low solid solubility of nitrogen from surfaces thereof at a nitrogen permeation temperature, the ferritic stainless steels in mechanical use are limited due to poor friction and abrasion properties.

(Patent Document 0001) Korean Patent No. 10-0831022

DISCLOSURE

Technical Problem

The present disclosure is directed to providing a triple-phase stainless steel including an austenite phase, a martensite phase, and a ferrite phase sequentially from the surface of the steel to the inside and a method of manufacturing the same.

Further, the present disclosure is directed to providing a triple-phase stainless steel having high strength and high toughness with excellent surface corrosion resistance by improving mechanical properties due to improvement of corrosion resistance and solid solubility enhancement of nitrogen by phase-transforming a ferritic phase into a martensite phase and an austenite phase via nitrogen permeation treatment and a method of manufacturing the triple-phase stainless steel.

Technical Solution

One aspect of the present disclosure provides a triple-phase stainless steel includes a ferrite phase formed in a central region, an austenite phase formed in an outermost region including a surface, and a martensite phase formed between the ferrite phase and the austenite phase.

The austenite phase, the martensite phase, and the ferrite phase may be sequentially formed inward from the surface of the stainless steel.

The stainless steel may include, in percent (%) by weight of the entire composition, 0.016% or less of carbon (C), 0.5% or less of silicon (Si), 17 to 20% of chromium (Cr), 1.0 to 5.0% of molybdenum (Mo), 0.1 to 0.2% of nickel (Ni), 1.0% or less of manganese (Mn), 0.01 to 0.2% of titanium (Ti), 0.1 to 0.6% of niobium (Nb), 0.1% or less of aluminum (Al), 0.03% or less of phosphorus (P), and 0.005% or less of sulfur (S), and the remainder of iron (Fe) and other inevitable impurities.

A content of nitrogen dissolved in the austenite phase may be 1.0% by weight or more, a content of nitrogen dissolved in the martensite phase may be from 0.6% by weight or more to less than 1.0% by weight, and a content of nitrogen dissolved in the ferrite phase may be less than 0.6% by weight.

A pitting corrosion resistance index of the stainless steel obtained by Equation (1) below may be 54 or greater: PREN=Cr+3.3 Mo+30 N−Mn Equation (1).

A content of nitrogen permeating into a surface (value of N in Equation (1)) may be 1.0% or more.

The austenite phase may have a particle size of 50 μm or less.

A surface hardness of the stainless steel may be a 300 HV or higher.

Another aspect of the present disclosure provides a method of manufacturing a triple-phase stainless steel including locating a ferritic stainless steel in a furnace chamber in which a temperature is maintained from 900 to 1,280° C., forming a nitrogen atmosphere by injecting nitrogen gas ($N_2$) into the furnace chamber, generating generator nitrogen (N) by decomposing the nitrogen gas ($N_2$), providing 1.0% or more of nitrogen permeating into the steel to phase-transform an outermost region into an austenite phase, providing 0.6 to 1.0% of nitrogen permeating into the steel to phase-transforming an outer region inside the outermost region into a martensite phase, and providing less than 0.6% of nitrogen permeating into the steel to phase-transforming a central are inside the martensite phase to maintain a ferrite phase.

Advantageous Effects

According to embodiments of the present disclosure, nitrogen may be permeated into and dissolved in a ferritic stainless steel plate via nitrogen permeation treatment using a high concentration of nitrogen. Accordingly, a ferritic phase of an outermost region of the steel plate including the surface is phase-transformed into an austenite phase having excellent surface corrosion resistance, the ferritic phase of an outer region of the steel plate inside the outermost region is phase-transformed into a martensite phase having high strength, and the ferritic phase of a central region of the steel plate is remained with high toughness. Thus, a triple-phase stainless steel sequentially including the austenite phase, the martensite phase, and the ferrite phase inward from the surface may be obtained.

Thus, corrosion resistance and mechanical properties of the stainless steel may be improved due to effects on enhancing formation of a solid solution of nitrogen by permeating and dissolving nitrogen. Also, since the central region includes the ferrite phase having high toughness, a triple-phase stainless steel having high toughness as well as excellent corrosion resistance and high strength may be provided.

In addition, the triple-phase stainless steel may be provided by using a solid phase alloy steel instead of a liquid phase, and nitrogen may be dissolved in an amount greater than a solid solubility limit in a liquid phase without using a dedicated pressurizing facility.

DESCRIPTION OF DRAWINGS

FIG. 1 is a graph illustrating solid solubility of nitrogen in alloy steels.

FIGS. 2 and 3 are diagrams for describing nitrogen permeation treatment performed after locating auxiliary samples adjacent to a ferritic stainless steel plate and performing a process of permeating nitrogen into a steel plate.

FIG. 4 is an optical microscopic image of a cross-section of a triple-phase stainless steel plate after nitrogen permeation treatment.

FIG. 5 is a photograph illustrating phase analysis results of the structure of FIG. 4 obtained by EBSD.

FIG. 6 is a graph for describing hardness of the triple-phase stainless steel plate with respect to depth from the surface after nitrogen permeation treatment.

BEST MODE

According to an embodiment of the present disclosure, a triple-phase stainless steel including a ferrite phase formed in a central region, an austenite phase formed in an outermost region including the surface, and a martensite phase formed between the ferrite phase and the austenite phase may be provided.

Modes of the Invention

Hereinafter, embodiments of the present disclosure will be described in detail with reference to the accompanying drawings. These embodiments are provided to fully convey the concept of the present disclosure to those of ordinary skill in the art. The present disclosure may, however, be embodied in many different forms and should not be construed as limited to the exemplary embodiments set forth herein. In the drawings, parts unrelated to the descriptions are omitted for clear description of the disclosure and sizes of elements may be exaggerated for clarity.

FIG. 1 is a graph illustrating solid solubility of nitrogen in alloy steels. FIGS. 2 and 3 are diagrams for describing nitrogen permeation treatment performed after locating auxiliary samples adjacent to a ferritic stainless steel plate and performing a process of permeating nitrogen into a steel plate.

Referring to FIGS. 1 to 3, a method of manufacturing a triple-phase stainless steel including performing a process of permeating nitrogen into a ferritic stainless steel according to an embodiment will be described.

As the ferritic stainless steel, a ferritic stainless steel plate including, in percent (%) by weight of the entire composition, 0.01% or less of carbon (C), 0.5% or less of silicon (Si), 17 to 20% of chromium (Cr), 1.0 to 5.0% of molybdenum (Mo), and the remainder of iron (Fe) and other inevitable impurities may be used. In addition, the inevitable impurities may include 0.1 to 0.2% of nickel (Ni), 1.0% or less of manganese (Mn), 0.01 to 0.2% of titanium (Ti), 0.1 to 0.6% of niobium (Nb), 0.1% or less of aluminum (Al), 0.03% or less of phosphorus (P), and 0.005% or less of sulfur (S).

For example, the ferritic stainless steel may be a STS 304 steel, a STS 444 steel, or the like.

The method of permeating nitrogen into the ferritic stainless steel includes locating a ferritic stainless steel plate 10 in a furnace chamber in which temperature is maintained at 1,280° C. or lower.

Referring to FIG. 1, a solid solubility of nitrogen in an alloy steel may be obtained. For example, in the case of an alloy steel including 18.4% of Cr, it may be confirmed that the solid solubility of nitrogen rapidly decreases to about 0.2% as the temperature increases from 1,280° C. Thus, the temperature of the furnace chamber may be maintained preferably at 1,280° C. or lower.

For example, more preferably the temperature in the furnace chamber may be maintained more preferably from 900 to 1,280° C. When the temperature of the furnace chamber is below 900° C., nitrogen gas ($N_2$) injected into the furnace chamber cannot be decomposed into generator nitrogen (N) so that nitrogen molecules ($N_2$) collide with the surface of the steel plate and a permeation rate of nitrogen (N) into the steel plate decreases. Thus, a lower limit of the temperature may be preferably 900° C.

Next, auxiliary samples 20 are located adjacent to the steel plate 10, and then nitrogen gas ($N_2$) is injected into the furnace chamber to form a nitrogen atmosphere and the nitrogen atmosphere is maintained for 1 minute or longer.

Although the auxiliary samples 20 may be the same alloy steel as the steel plate 10, the embodiment is not limited thereto, but different metals may be used therefor. For example, the auxiliary samples 20 may be the same alloy steel as the steel plate 10 or a plurality of steel plates 10 may be disposed adjacent to each other to serve as the auxiliary samples 20. Manufacturing costs may be reduced and efficiency may be increased by mass processing of the same steel species.

In addition, surface shapes of the auxiliary samples 20 facing the steel plate 10 may be the same as or similar to that of the steel plate 10 so as to obtain a uniform nitrogen permeation effect.

In addition, in order to obtain the uniform nitrogen permeation effect into the steel plate 10, the auxiliary samples 20 may have a size equal to or greater than that of the steel plate 10.

The nitrogen atmosphere is formed by injecting nitrogen gas ($N_2$) by flowing a predetermined amount of $N_2$ gas into the furnace chamber. The nitrogen gas ($N_2$) in the form of molecules is decomposed at a high temperature in the furnace chamber to generate generator nitrogen (N). Gradually, the furnace chamber is filled with generator nitrogen (N).

Alternatively, when concentration partial pressure of generator nitrogen (N) needs to be activated in addition to the method of flowing nitrogen gas ($N_2$) forming the nitrogen atmosphere with no pressure applied thereto, nitrogen gas ($N_2$) may continuously be injected into the furnace chamber to reach a partial pressure of 1.0 kgf/cm$^2$ or more in the furnace chamber.

The steel plate 10 and the auxiliary samples 20 may be located to be as close as possible. For example, an interval between the steel plate 10 and the auxiliary samples 20 may be 1,000 nm or less.

The inside of the furnace chamber is maintained at a high temperature and thus the generated generator nitrogen (N) moves very actively. Thus, a permeation efficiency may decrease due to collision between the generator nitrogen atoms or between the generator nitrogen (N) and the surface of the steel plate 10.

Thus, by locating the steel plate 10 and the auxiliary samples 20 adjacent to each other, the concentration of the generator nitrogen (N) may be relatively increased between the steel plate 10 and the auxiliary samples 20. Very active movement of the generator nitrogen (N) between the steel plate 10 and the auxiliary samples 20 may increase the number of collision with the steel plate 10. Accordingly, nitrogen may efficiently permeate into the steel plate 10 deeply to a central region of the steel plate 10.

The steel plate 10 may be maintained in the furnace chamber for 1 minute or longer. As a maintaining time increases, nitrogen may permeate more into the steel plate 10. However, in order to obtain corrosion resistance and mechanical strength suitable for the object of the present disclosure, the steel plate 10 may be maintained in the furnace chamber for 30 minutes to 10 hours while adjusting the temperature therein from 900 to 1,280° C.

FIG. 4 is an optical microscopic image of a cross-section of a triple-phase stainless steel plate after nitrogen permeation treatment. FIG. 5 is a photograph illustrating phase analysis results of the structure of FIG. 4 obtained by EBSD.

Referring to FIGS. 4 and 5, the triple-phase stainless steel manufactured according to the method of manufacturing a triple-phase stainless steel according to the present disclosure has a structure in which a ferrite phase is formed in the central region, a martensite phase is formed on the outer periphery of the ferrite phase, and an austenite phase formed in the outermost region including the surface.

In this regard, the content of nitrogen permeating to phase-transform the phase of the outermost region including the surface into the austenite phase may be 1.0% or more and the content of nitrogen permeating to phase-transform the phase of an outer region inside the outermost region into the martensite phase may be from 0.6 to 1.0%. Thus, the austenite phase, the martensite phase, and the ferrite phase may be sequentially formed from the surface of the stainless steel to the inside to form a triple-phase stainless steel.

That is, although the entire ferritic stainless steel plate has only the ferrite phase before the nitrogen permeation treatment, the ferrite phase of the outermost region including the surface of the steel plate is phase-transformed to the austenite phase via the martensite phase and the ferrite phase of an outer region inside the outermost region of the steel plate is phase-transformed to the martensite phase as solid solutions of nitrogen are formed, and the central region of the steel plate is maintained in the ferrite phase without being phase-transformed.

In addition, the triple-phase stainless steel provided according to the manufacturing method according to an embodiment of the present disclosure has characteristics different from those of dual-phase steels commonly used in the art.

In dual-phase steels commonly used in the art, different phases are present in a mixed state on the surface and the inside. However, the triple-phase stainless steel according to an embodiment may have improved corrosion resistance since the outermost region including the surface is formed of the hard austenite phase, improved strength since the outer region inside the outermost region is formed of the martensite phase, and improved toughness since the central region inside the outer region is formed of the soft ferrite phase. That is, since the central region is formed of the ferrite phase, impact resistance of the stainless steel may be improved.

In addition, 1.0% or more of nitrogen permeating and diffusing into the surface of the triple-phase stainless steel is not precipitated but forms a solid solution below the surface, thereby inhibiting the growth of particles of the austenite phase such that a particle size is 50 μm or less.

FIG. 6 is a graph for describing hardness of the triple-phase stainless steel plate with respect to depth from the surface after nitrogen permeation treatment.

Corrosion resistance may vary according to the N content permeating into the ferritic stainless steel from the surface. Equation (1) below is used to derive pitting resistance equivalent number (PREN) index indicating a pitting corrosion resistance index of a material.

$$PREN=Cr+3.3Mo+30N-Mn \quad \text{Equation (1)}$$

Particularly, it may be confirmed the surface formed of the austenite phase has a hardness greater than those of the martensite phase and the ferrite phase formed inside the austenite phase due to a solid solubility enhancement effect of the nitrogen permeating into the surface. In this case, the content of nitrogen permeating into the surface may be 1.2%.

In the case where the content of nitrogen permeating into the surface is 1.2%, Equation (2) below may be obtained by substituting the N content into Equation (1) above to obtain the PREN index.

$$PREN=18.66+3.3*1.74+30*1.2-0.85=60.7 \quad \text{Equation (2)}$$

In Equation 2, Cr: 18.66%, Mo: 1.74%, and Mn: 0.85%

Based on the above results, it may be confirmed that a surface hardness of the triple-phase stainless steel is about three times or greater than that of an STS 304 steel, commonly known as an austenitic stainless steel, having a PREN index of 18.0.

Specifically, the surface hardness of the ferritic stainless steel plate was about 160 to 180 HV before the nitrogen permeation treatment. However, the surface hardness of the triple-phase stainless steel plate according to an embodiment of the present disclosure is considerably increased to 300 HV or higher after the nitrogen permeation treatment.

On the contrary, the inside of the triple-phase stainless steel has the martensite phase and the ferrite phase and has a lower hardness of about 200 to 280 HV than the surface hardness after the nitrogen permeation treatment.

While the present disclosure has been particularly described with reference to exemplary embodiments, it should be understood by those of skilled in the art that various changes in form and details may be made without departing from the spirit and scope of the present disclosure.

INDUSTRIAL AVAILABILITY

The triple-phase stainless steel according to embodiments of the present disclosure has excellent friction resistance and wear resistance and is industrially applicable to mechanical applications.

The invention claimed is:

1. A triple-phase stainless steel comprising: in percent (%) by weight of the entire composition, 0.01% or less of carbon (C), 0.5% or less of silicon (Si), 17 to 20% of chromium (Cr), 1.0 to 5.0% of molybdenum (Mo), 0.1 to 0.2% of nickel (Ni), 1.0% or less of manganese (Mn), 0.01 to 0.2% of titanium (Ti), 0.1 to 0.6% of niobium (Nb), 0.1% or less of aluminum (Al), 0.03% or less of phosphorus (P), and 0.005% or less of sulfur (S), and the remainder of iron (Fe) and other inevitable impurities, wherein the austenite phase, the martensite phase, and the ferrite phase are sequentially formed inward from the surface of the stainless steel, wherein a content of nitrogen dissolved in the austenite phase is 1.0% by weight or more, a content of nitrogen dissolved in the martensite phase is from 0.6% by weight or more to less than 1.0% by weight, and a content of nitrogen dissolved in the ferrite phase is less than 0.6% by weight.

2. The triple-phase stainless steel of claim 1, wherein a ferrite phase formed in a central region;

an austenite phase formed in an outermost region comprising a surface; and a martensite phase formed between the ferrite phase and the austenite phase.

3. The triple-phase stainless steel of claim 1, wherein a pitting corrosion resistance index of the stainless steel obtained by Equation (1) below is 54 or greater:

$$PREN=Cr+3.3\ Mo+30\ N-Mn \qquad \text{Equation (1)}$$

4. The triple-phase stainless steel of claim 1, wherein a content of nitrogen permeating into a surface, which is a value of N in Equation (1) is 1.0% or more.

5. The triple-phase stainless steel of claim 1, wherein the austenite phase has a particle size of 50 μm or less.

6. The triple-phase stainless steel of claim 1, wherein a surface hardness of the stainless steel is a 300 HV or higher.

7. A method of manufacturing the triple-phase stainless steel of claim 1, the method comprising:

locating a ferritic stainless steel in a furnace chamber in which a temperature is maintained from 900 to 1,280° C.;

forming a nitrogen atmosphere by injecting nitrogen gas ($N_2$) into the furnace chamber; generating generator nitrogen (N) by decomposing the nitrogen gas ($N_2$), providing 1.0% or more of nitrogen permeating into the steel to phase-transform an outermost region into an austenite phase;

providing 0.6 to 1.0% of nitrogen permeating into the steel to phase-transform an outer region inside the outermost region into a martensite phase; and providing less than 0.6% of nitrogen permeating into the steel to phase-transform a central are inside the martensite phase to maintain a ferrite phase.

* * * * *